US005551684A

United States Patent [19]

Sata

[11] Patent Number: 5,551,684

[45] Date of Patent: Sep. 3, 1996

[54] SHEET-MATERIAL AUTOMATIC FEEDING DEVICE

[75] Inventor: Junichi Sata, Kawasaki, Japan

[73] Assignee: Canon Kabushiki Kaisha, Tokyo, Japan

[21] Appl. No.: 463,864

[22] Filed: Jun. 6, 1995

Related U.S. Application Data

[63] Continuation of Ser. No. 165,588, Dec. 13, 1993, abandoned.

[30] Foreign Application Priority Data

Dec. 28, 1992 [JP] Japan ..... 4-361202

[51] Int. Cl.[6] ..... B65H 7/02

[52] U.S. Cl. ..... 271/110; 271/118

[58] Field of Search ..... 271/110, 111, 271/265.01, 265.02, 265.03, 227, 117, 118; 358/488, 496, 498

[56] References Cited

U.S. PATENT DOCUMENTS 4,775,139 10/1988 Honjo ..... 271/111 X
4,953,037 8/1990 Ito et al. .
5,058,874 10/1991 Miyoshi ..... 271/117 X
5,209,465 5/1993 Sayama ..... 271/117 X
5,219,156 6/1993 Mori ..... 271/110

*Primary Examiner*—William E. Terrell
*Assistant Examiner*—Ti Kelly
*Attorney, Agent, or Firm*—Fitzpatrick, Cella, Harper & Scinto

[57] ABSTRACT

A sheet-material automatic feeding device individually separates and feeds sheets of a sheet material mounted on a tray. The device includes a sheet-material-leading-end detection sensor for detecting the leading end of the sheet material mounted on the tray, and a sheet-material prefeeding roller for feeding the sheet material mounted on the tray to a sheet-material separation/feeding unit provided at a position downstream from the sheet-material prefeeding roller. When the sheet-material-leading-end detection sensor has detected the leading end of the sheet material mounted on the tray, the sheet-material prefeeding roller is mounted on and presses a leading-end portion of the sheet material mounted on the tray.

9 Claims, 4 Drawing Sheets

SHEET-MATERIAL AUTOMATIC FEEDING DEVICE

This application is a continuation of application Ser. No. 08/165,588, filed Dec. 13, 1993, now abandoned.

BACKGROUND OF THE INVENTION

1. Field of the Invention

This invention relates to a sheet-material automatic feeding device which is used in an image forming apparatus, such as a facsimile, a printer, a copier or the like.

2. Description of the Related Art

In an image forming apparatus, such as a facsimile, a printer, a copier or the like, a sheet-material automatic feeding device, which individually separates and feeds sheets of a sheet material mounted on sheet-material mounting means, is used as means for feeding an original sheet material or a recording sheet material to an image reading unit or to an image forming unit.

In such a sheet-material automatic feeding device, a sheet material mounted on sheet-material mounting means is first fed by sheet-material prefeeding means to sheet-material separation/feeding means provided downstream. Sheets of the sheet material are individually separated by the sheet-material separation/feeding means. Each of the separated sheets is fed to sheet-material conveying means provided downstream of the sheet-material separation/feeding means, and is further fed by the sheet-material conveying means to an image reading unit or to an image forming unit.

Accordingly, in the sheet-material automatic feeding device, the sheet material must be mounted on the sheet-material mounting means at such a position that it can be prefed by the sheet-material prefeeding means.

The sheet material mounted on the sheet-material mounting means can be prefed by the sheet-material prefeeding means when the leading end of the sheet material is positioned between a position where it passes through the sheet-material prefeeding means and a position immediately upstream of the sheet-material separation/feeding means.

Therefore, in a conventional sheet-material automatic feeding device, the following approaches are, for example, adopted in order that a sheet material mounted on sheet-material mounting means can be securely prefed by sheet-material prefeeding means.

(1) The user is directed by an instruction manual or the like to mount the sheet material on sheet-material mounting means so that the leading end of the sheet material contacts a nip portion of sheet-material separation/feeding means (a first conventional approach).

(2) The position for placement of the trailing end of each sheet material is indicated on the sheet-material mounting means, so that a sheet material is mounted on the sheet-material mounting means while aligning its trailing end with the indicated position (a second conventional approach).

(3) An openable/closable shutter is provided on a conveying path between the sheet-material prefeeding means and sheet-material separation/feeding means. When the leading end of the sheet material contacts the shutter, the sheet material is mounted on the sheet-material mounting means (a third conventional approach).

In the above-described first conventional approach, if the leading end of the sheet material contacts the nip portion of the sheet-material separation/feeding means with a force equal to or greater than a predetermined pressing force, the leading end of the sheet material will sometimes pass through the nip portion. If the sheet material is fed under such circumstances, two or more sheets of the sheet material are in some cases simultaneously fed.

In the second conventional approach, the operation of aligning the rear end of the sheet material with the indicated position on the sheet-material mounting means is troublesome when the sheet material comprises a large amount of sheets. Furthermore, this approach is useless when the size of the sheet material is not one of the predetermined formats, causing the same problem as in the first conventional approach.

In the third conventional approach, since the shutter is openably and closably driven by an actuator, such as an electromagnetic solenoid or the like, the cost of the sheet-material automatic feeding device increases.

SUMMARY OF THE INVENTION

The present invention has been made in consideration of the above-described problems.

It is an object of the present invention to provide an inexpensive sheet-material automatic feeding device, in which a sheet material can be mounted on sheet-material mounting means at such a mounting position that the sheet material can be securely prefed by a sheet-material prefeeding roller irrespective of the size of the sheet material, and the sheet material can be easily set without causing simultaneous feeding of two or more sheets of the sheet material.

According to one aspect of the present invention, there is a sheet-material automatic feeding device comprising sheet-material-leading-end detection means for detecting the leading end of a sheet material mounted on sheet-material mounting means, and sheet-material prefeeding means for feeding the sheet material mounted on the sheet-material mounting means to sheet-material separation/feeding means provided at a position downstream from the sheet-material prefeeding means. When the sheet-material-leading-end detection means has detected the leading end of the sheet material mounted on the sheet-material mounting means, the sheet-material prefeeding means is brought into contact with a leading-end portion of an upper surface of the sheet material mounted on the sheet-material mounting means.

In one embodiment, the sheet-material-leading-end detection means detects the leading end of the sheet material mounted on the sheet-material mounting means on a conveying path between the sheet-material prefeeding means and the sheet-material separation/feeding means.

According to the sheet-material automatic feeding device having the above-described configuration, when the leading end of the sheet material mounted on the sheet-material mounting means moves downstream, the sheet-material-leading-end detection means detects the leading end of the sheet material. By this detection, the sheet-material prefeeding means is mounted on the leading-end portion of the sheet material.

Accordingly, movement of the leading end of the sheet material mounted on the sheet-material mounting means is prevented by the sheet-material prefeeding means, leaving the sheet material, at such a position that the sheet material can be prefed by the sheet-material prefeeding means. In this state, the setting of the sheet material on the sheet-material mounting means is complete.

It is thereby possible to securely prefeed the sheet material mounted on the sheet-material mounting means by the sheet-material prefeeding means irrespective of the size of the sheet material.

Since it is only necessary to move the leading end of the sheet material downstream of the sheet-material mounting means, the sheet material can be easily set on the sheet-material mounting means.

Since downstream movement of the sheet material set on the sheet-material mounting means is prevented by the sheet-material prefeeding means, the leading end of the sheet material does not pass through a nip portion of the sheet-material separation/feeding means. Hence, simultaneous feeding of two or more sheets of the sheet material is prevented.

Since it is only necessary to provide the sheet-material-leading-end detections means, the cost of the device can be reduced.

As described above, in the sheet-material automatic feeding device of the present invention, when the sheet-material-leading-end detection means detects the leading end of the sheet material on a conveying path between the sheet-material prefeeding means and the sheet-material separation/feeding means, or at a position upstream from the sheet-material prefeeding means, the sheet-material prefeeding means is brought into contact with the leading-end portion of the sheet material mounted on the sheet-material mounting means.

It is thereby possible to easily mount the sheet material on the sheet-material mounting means at such a mounting position that the sheet material can be securely prefed by the sheet-material prefeeding means irrespective of the size of the sheet material.

DESCRIPTION OF THE PREFERRED EMBODIMENTS

Preferred embodiments of the present invention will now be described with reference to the drawings.

First Embodiment

Figure 1:
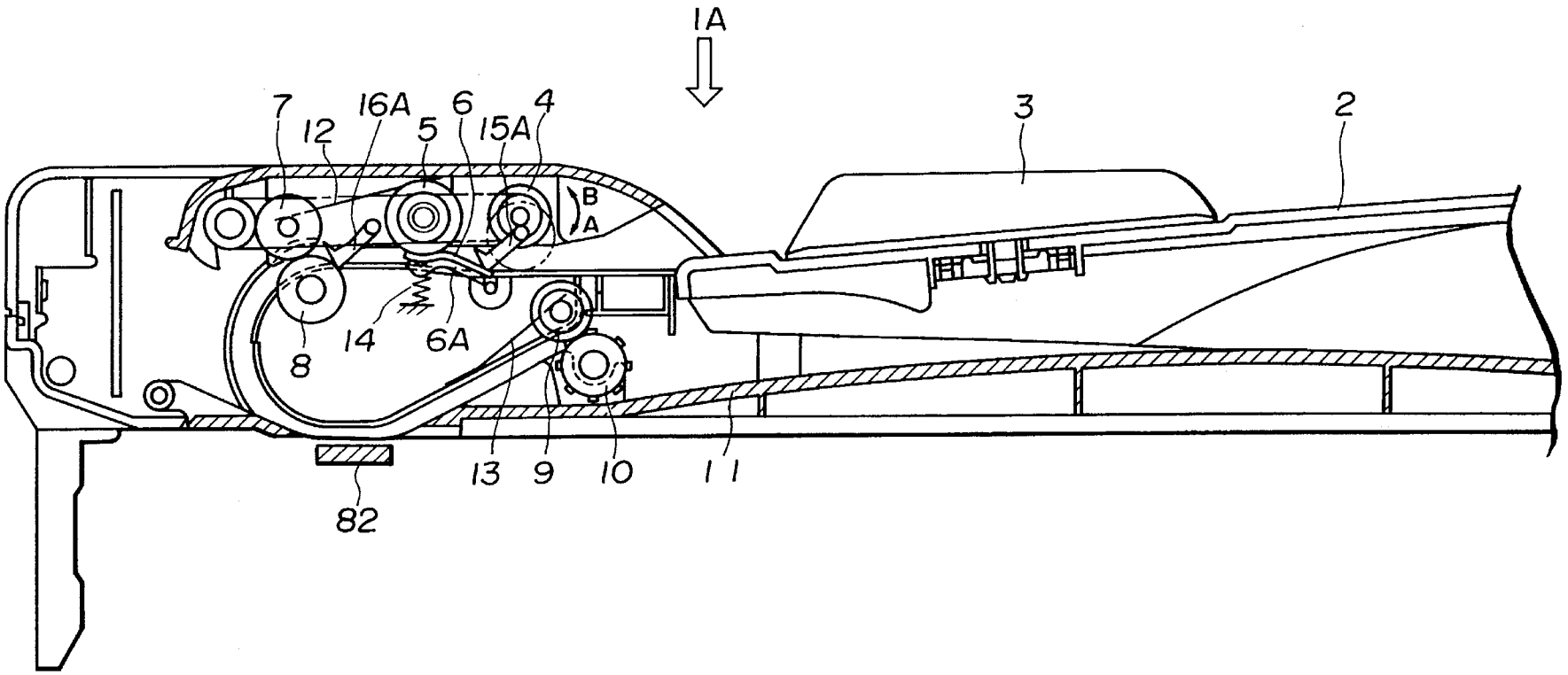
FIG. 1 is a longitudinal sectional side view illustrating the configuration of a sheet-material automatic feeding device for a facsimile apparatus according to a first embodiment of the present invention.

FIG. 1 illustrates a sheet-material automatic feeding device for a facsimile apparatus according to a first embodiment of the present invention.

In sheet-material automatic feeding device 1A of the present embodiment, tray 2 is used for mounting a sheet material comprising a plurality of sheets. Regulating plate 3 regulates the position of the sheet material mounted on tray 2 in the direction of its width.

Tray 2 is disposed at the most upstream position of the present sheet-material automatic feeding device and prefeeding roller 4, feeding roller 5, conveying roller 8 and discharging roller 10 are sequentially disposed at positions downstream from tray 2.

Separation piece 6, made of rubber, is for individually separating sheets of the sheet material. Separation piece 6 contacts feeding roller 5 with a predetermined pressure provided by separation spring 14 via separation arm 6A. Conveying roller 7 and discharging roller 9 contact conveying roller 8 and discharging roller 10 with predetermined pressures provided by leaf springs 12 and 13, respectively.

Detection arm 15A of sheet-material-leading-end detection sensor 15 for detecting the leading end of the sheet material mounted on tray 2 is disposed in the conveying path between prefeeding roller 4 and feeding roller 5. Detection arm 16A of sheet-material-leading-end detection sensor 16 for detecting the leading end of the sheet material fed by feeding roller 5 is disposed in the conveying path between feeding roller 5 and conveying roller 8.

Figure 2:
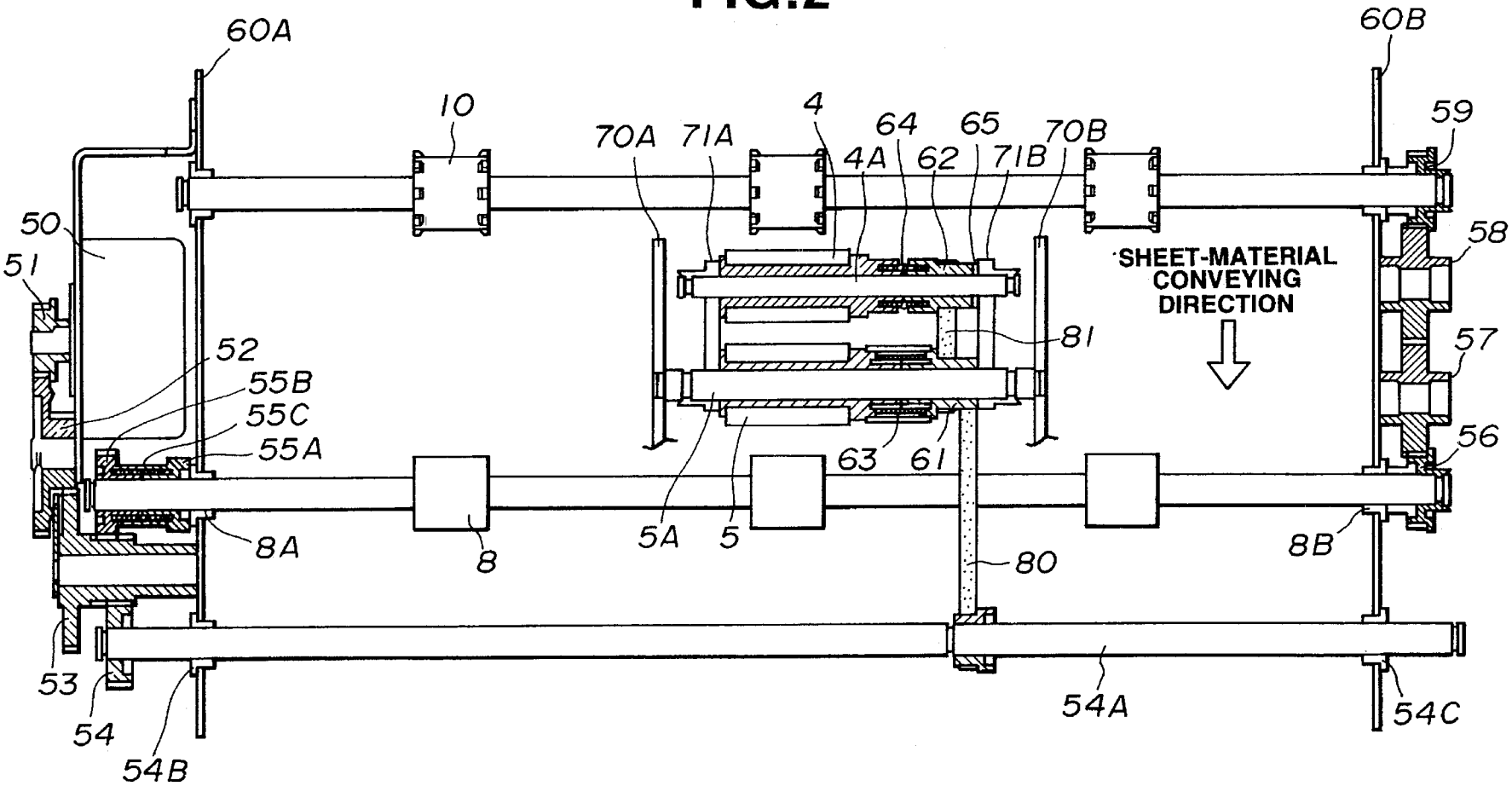
FIG. 2 is a transverse sectional development plan view illustrating the configuration of a driving system of the sheet-material automatic feeding device shown in FIG. 1.

FIG. 2 illustrates the configuration of a driving system of the sheet-material automatic feeding device.

Gear 51 is fixed to the driving shaft of stepping motor 50, serving as a driving source. A rotatably pivoted stepped gear 52 meshes with gear 51, and a rotatably pivoted stepped gear 53 meshes with stepped gear 52.

Conveying roller 8 is rotatably pivoted on side plates 60A and 60B by bearings 8A and 8B, respectively. Drum 55A is fixed and gear 55B is rotatably pivoted at one end portion of the shaft of conveying roller 8. Drum 55A and the drum unit of gear 55B are configured so that the drive of rotation of gear 55B is transmitted in only one direction to drum 55A by clutch spring 55C.

Gear 56 is fixed to another end portion of the shaft of conveying roller 8, so that gear 56 transmits the drive to gear 59 fixed to the shaft of discharging roller 10 via gears 57 and 58.

Gear 54 is fixed to one end of feeding driving shaft 54A rotatably pivoted on side plates 60A and 60B by bearings 54B and 54C, respectively. Gear 54 meshes with gear 53.

Rotatable pulley 61 and feeding roller 5 are pivoted around feeding shaft 5A mounted on ribs 70A and 70B, and clutch spring 63 is wound around a drum unit provided pulley 61 and feeding roller 5. The drive of feeding driving shaft 54A is transmitted to pulley 61 via belt 80. In this case, the drive of rotation of pulley 61 in only one direction is transmitted to feeding roller 5.

Arms 71A and 71B are swingable around feeding shaft 5A and are mounted on two end portions of feeding shaft 5A. Prefeeding shaft 4A is fixed to the distal ends of arms 71A and 71B.

Rotatable pulley 62, prefeeding roller 4 and friction pad 65 are pivoted around prefeeding shaft 4A. Compression spring 64 is provided between pulley 62 and prefeeding roller 4, and friction pad 65 contacts arm 71B with a predetermined pressure. The drive of pulley 61 is transmitted to pulley 62 via belt 81.

By a frictional force produced on arm 71B by friction pad 65, a predetermined swinging force is produced in the direction of rotation of pulley 62. That is, when prefeeding roller 4 rotates in the direction of conveying the sheet material downstream, it swings in the direction of arrow A shown in FIG. 1 to contact the sheet material. On the other hand, when prefeeding roller 4 rotates in the direction of conveying the sheet material toward the upstream side, it swings in the direction of arrow B shown in FIG. 1 to leave the sheet material.

According to the above-described configuration, when motor 50 rotates in the forward direction (the counterclockwise direction as viewed in FIG. 1), prefeeding roller 4 swings in the direction of arrow A shown in FIG. 1, as described above, to contact the sheet material and rotate in the clockwise direction. Clutch spring 63 is switched on, and feeding roller 5 rotates in the sheet-material conveying direction (the clockwise direction as viewed in FIG. 1). At the same time, clutch spring 55C is switched off, and conveying roller 8 and discharging roller 10 do not rotate.

When motor 50 rotates in the reverse direction (the clockwise direction), prefeeding roller 4 swings in the direction of arrow B shown in FIG. 1, as described above, to separate from the sheet material. Clutch spring 63 is switched off, and feeding roller 5 does not rotate in the sheet-material conveying direction. At the same time, clutch spring 55C is switched off, and conveying roller 8 and discharging roller 10 rotate in the sheet-material conveying direction.

Figure 3:
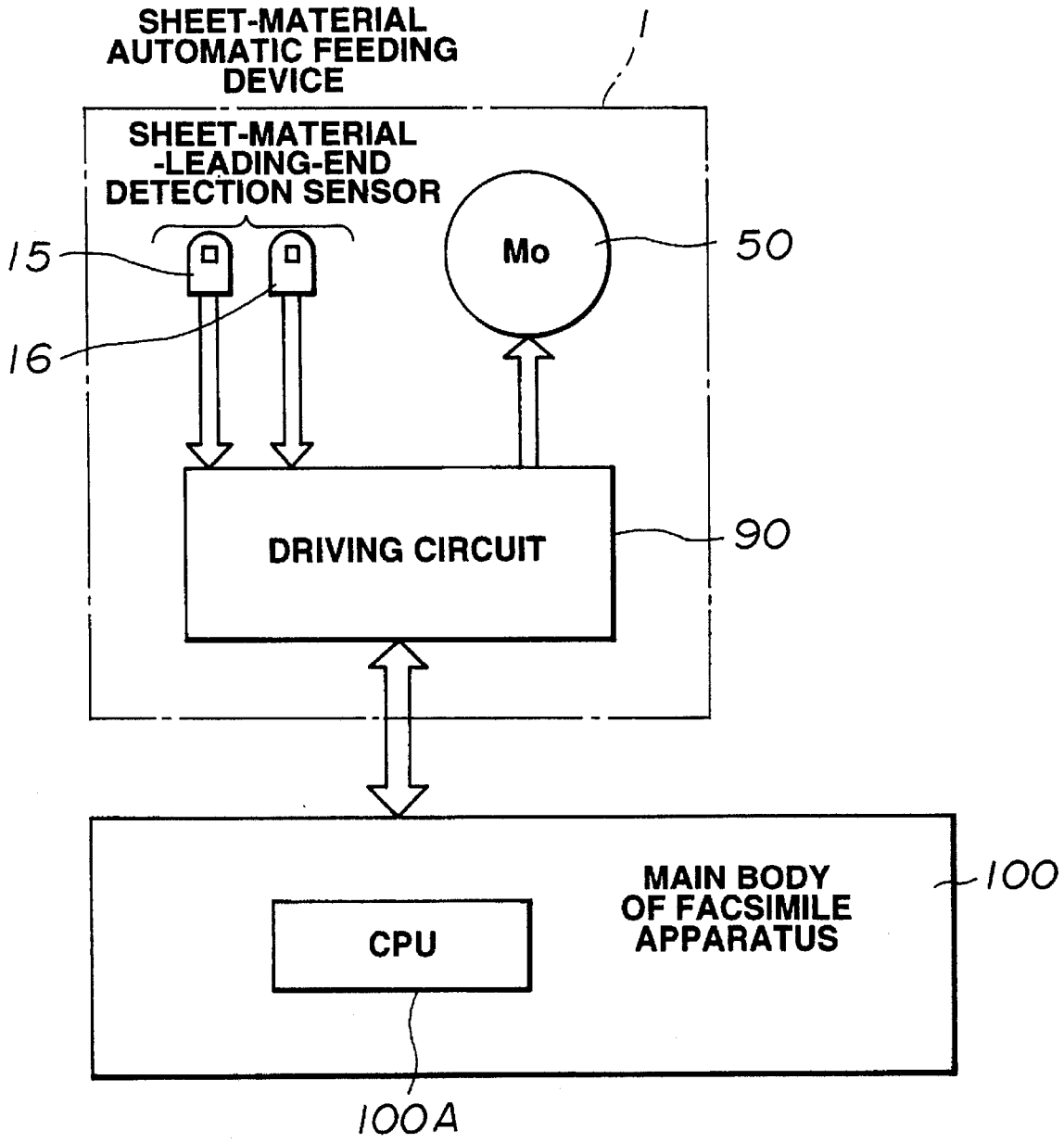
FIG. 3 is a block diagram illustrating a control circuit of the sheet-material automatic feeding device shown in FIG. 1.

Next, the operation of the sheet-material automatic feeding device will be described with reference to FIGS. 1 and 3.

Sheet material, comprising a plurality of sheets, is mounted on tray 2, and the leading end of the sheet material is moved toward downstream side of tray 2. When the leading end of the sheet material passes through detection arm 15A, detection arm 15A operates, Whereby sheet-material-leading-end detection sensor 15 detects the leading end of the sheet material and generates a detection signal.

When the detection signal from sheet-material-leading-end detection sensor 15 is input to driving circuit 90, driving circuit 90 rotates motor 50 in the forward direction (the counterclockwise direction) for a predetermined time period, i.e., the time period necessary for prefeeding roller 4 to reach tray 2.

Prefeeding roller 4 thereby swings in the direction of arrow A shown in FIG. 1 into contact with the leading end of the sheet material on tray 2. At that time, prefeeding roller 4 rotates only slightly and feeds the sheet material only a very small amount, if at all. Prefeeding roller 4 grasps the sheet material by the frictional force and holds it, so that the sheet material on tray 2 is not moved further downstream. In this state, the setting of the sheet material on tray 2 is completed. At that time, the sheet material on tray 2 is mounted at such a mounting position that prefeeding roller 4 contacts the leading end of the sheet material and the sheet material can be conveyed downstream.

In this state, if motor 50 is rotated in the forward direction as a result of a sheet-material feeding start signal from CPU 100A of main body 100 of the facsimile apparatus, prefeeding roller 4 rotates while contacting the leading end of the sheet material with a predetermined swinging pressure, feeding the sheet material to feeding roller 5 at the downstream side.

The sheet-material feeding start signal may be generated from the CPU at a predetermined time after sensor 15A has detected the sheet material, or when a feeding start button has been depressed, either of which may serve as a feeding starting means.

Only the uppermost sheet of the fed sheet material is separated by separation piece 6, and the separated sheet is fed downstream by feeding roller 5.

When the leading end of the fed sheet has passed through detection arm 16A, feeding roller 5 continues feeding the sheet downstream for a predetermined time period in response to a detection signal from sheet-material-leading-end detection sensor 16. When the leading end of the sheet has contacted a nip portion between conveying roller 8 and conveying roller 7 it begins to form a loop and once the posture (an oblique movement) of the sheet has been corrected, feeding roller 5 stops.

Thereafter, motor 50 is rotated in the reverse direction to convey the sheet to image reading unit 82 (more specifically, reference numeral 82 represents a platen glass below which a sensor for reading, an optical system and the like are disposed) by conveying roller 8. After image reading, the sheet is discharged onto sheet discharging tray 11 by discharging roller 10. At that time, prefeeding roller 4 rises and feeding roller 5 stops. Feeding roller 5 is rotated by the feeding of the sheet.

In the same manner, every time the preceding sheet is discharged onto sheet discharging tray 11, the above-described prefeeding, feeding, coveying and discharging operations of each sheet are repeated until a detection signal is not output from sheet-material-leading-end detection sensor 15. When the final sheet has been discharged onto sheet discharging tray 11, the rotation of motor 50 is stopped, and setting of the subsequent sheet material on tray 2 is awaited. Arms 71A and 71B of prefeeding roller 4 are held at raised positions by the load of motor 50 unless belt 81 rotates backward.

Second Embodiment

Figure 4:
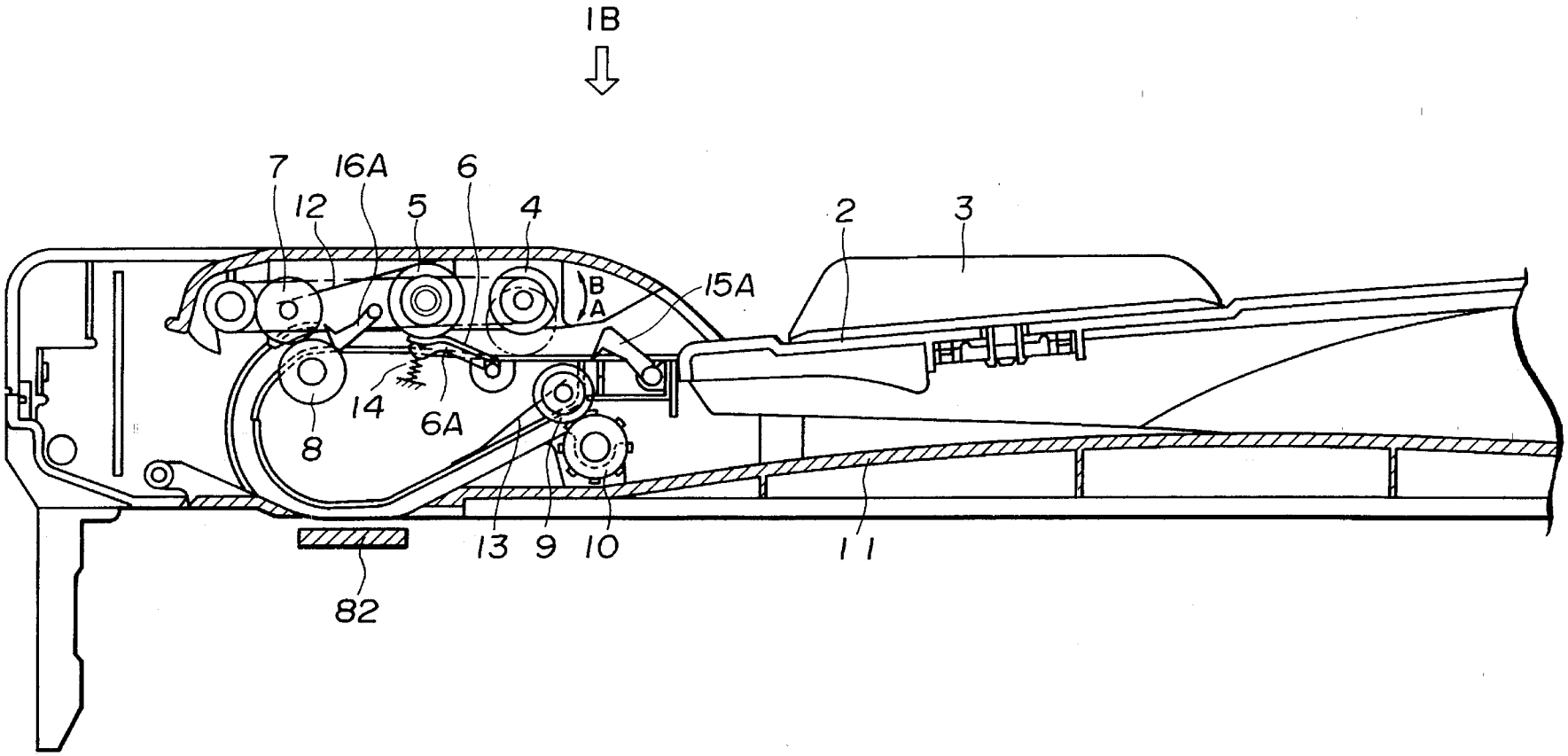
FIG. 4 is a longitudinal sectional side view illustrating the entire configuration of a sheet-material automatic feeding device for a fascimile apparatus according to a second embodiment of the present invention.

FIG. 4 is a diagram illustrating the entire configuration of a sheet-material automatic feeding device for a facsimile apparatus according to a second embodiment of the present invention.

In FIG. 4, the same components as those shown in FIG. 1 are represented by the same reference numerals, and an explanation will be omitted for components having the same configurations and functions as those shown in FIG. 1.

In the present sheet-material automatic feeding device 1B, detection arm 15A of sheet-material-leading-end detection sensor 15 is disposed upstream of prefeeding roller 4.

The operation of the sheet-material automatic feeding device of the second embodiment will now be described with reference to FIGS. 3 and 4.

A sheet material, comprising a plurality of sheets, is mounted on tray 2, and the leading end of the sheet material is moved downstream from tray 2. When the leading end of the sheet material has passed through detection arm 15A, detection arm 15A operates, and sheet-material-leading-end detection sensor 15 detects the leading end of the sheet material.

When a signal from sheet-material-leading-end detection sensor 15 has been input to driving circuit 90, driving circuit 90 rotates motor 50 in the reverse direction (the clockwise direction) for a predetermined time period, to swing prefeeding roller 4 in the direction of arrow B shown in FIG. 4. Thereafter, motor 50 is rotated in the forward direction (the counterclockwise direction) for a predetermined time period, to swing prefeeding roller 4 in the direction of arrow A shown in FIG. 4 until it contacts the upper surface of the sheet material at its leading end.

Prefeeding roller 4 grasps the sheet material by the frictional force and holds it, so that the sheet material on tray 2 is not moved further downstream. In this state, the setting of the sheet material on tray 2 is completed. At that time, the sheet material on tray 2 is mounted at such a mounting position that prefeeding roller 4 contacts the upper surface of the sheet material at its leading end and the sheet material can be conveyed downstream.

Thereafter, the same feeding, conveying and discharging operations of each sheet of the sheet material as in the first embodiment are performed.

In this embodiment, prefeeding roller 4 is usually in a lowered position. Since it is unnecessary to hold prefeeding roller 4 at a raised position, the size of prefeeding roller 4 can be increased. Accordingly, the sheet material can be securely grasped and fed.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A sheet-material automatic feeding device for individually separating and feeding sheets from sheet material mounted on sheet-material mounting means, said device comprising:

sheet-material-leading-end detection means for detecting the leading end of the sheet material mounted on the sheet-material mounting means and for generating a detection signal in response to the detection of the leading end;

sheet-material prefeeding means for feeding the sheet material mounted on the sheet-material mounting means to sheet-material separating/feeding means provided downstream of said sheet-material prefeeding means, said sheet-material prefeeding means being movable between a non-feed position out of contact with the sheet material and a feed position in contact with the sheet material; and control means for controlling movement of said sheet-material prefeeding means so that in response to the detection signal, said sheet-material prefeeding means is moved to the feed position where it is in contact with a leading-end portion of an upper surface of the sheet material mounted on the sheet-material mounting means, wherein said sheet material prefeeding means temporarily holds the sheet material upstream of the sheet-material separation/feeding means.

2. A device according to claim 1, further comprising feeding starting means for starting the operation of said sheet-material prefeeding means in order to feed the mounted sheet material.

3. A device according to claim 1, wherein said sheet-material-leading-end detection means detects the leading end of the sheet material on a conveying path between said sheet-material prefeeding means and said sheet-material separation/feeding means.

4. A device according to claim 3, wherein said sheet-material prefeeding means comprises a roller, whose waiting position is out of contact with the sheet materials.

5. A device according to claim 1, wherein said sheet-material-leading-end detection means detects the leading end of the sheet material mounted on the sheet-material mounting means at a position upstream from said sheet-material prefeeding means.

6. A device according to claim 5, wherein said sheet-material prefeeding means comprises a roller, whose waiting position is in contact with the sheet materials, and wherein said sheet-material prefeeding means first rises and then descends to contact the leading-end portion of the sheet material.

7. A sheet-material automatic feeding device for feeding sheets from sheet material mounted on sheet-material mounting means, said device comprising:

sheet-material-leading-end detection means for detecting a leading end of the sheet material mounted on the sheet-material mounting means and for generating a detection signal in response to the detection of the leading end;

sheet-material prefeeding means for feeding the sheet material mounted on the sheet-material mounting means to sheet-material feeding means provided downstream of said sheet-material prefeeding means, said sheet-material prefeeding means being movable between a non-feed position out of contact with the sheet material and a feed position in contact with the sheet material;

feeding starting means for starting an operation of said sheet-material prefeeding means in order to feed the mounted sheet material; and control means for controlling movement of said sheet-material prefeeding means so that in response to the detection signal, said sheet-material prefeeding means is moved to the feed position where it is in contact with a leading-end portion of an upper surface of the sheet material mounted on the sheet-material mounting means, and then the feeding of said sheet-material prefeeding means is started by operating said feeding starting means.

8. A device according to claim 1, wherein said sheet-material prefeeding means and said sheet-material separation/feeding means each are rotatable members, said device further comprising:

arm means for rotatably supporting said sheet-material prefeeding rotary member, said arm means being supported swingably by and coaxially with respect to said sheet-material separation/feeding rotary member;

friction means intervening between said arm member and said sheet-material prefeeding rotary member; and transmitting means for transmitting rotary force to each of said rotary members.

9. A device according to claim 8, wherein the swinging force is interrupted just after said sheet-material prefeeding rotary member is brought into contact with the sheet material so that the rotation of said sheet-material prefeeding rotary member on its own axis stops.

* * * * *

UNITED STATES PATENT AND TRADEMARK OFFICE

CERTIFICATE OF CORRECTION

PATENT NO. : 5,551,684
DATED : September 3, 1996
INVENTOR(S) : SATA

It is certified that error appears in the above-indentified patent and that said Letters Patent is hereby corrected as shown below:

COLUMN 3

Line 15, change "detections" to --detection--.

COLUMN 5

Line 23, change "Whereby" to --whereby--.

COLUMN 7

Line 23, change "separating/feeding" to --separation/feeding--.

Signed and Sealed this

Twentieth Day of May, 1997

*Attest:*

*Attesting Officer*

BRUCE LEHMAN

*Commissioner of Patents and Trademarks*